US007051459B1

(12) United States Patent
Wigutow

(10) Patent No.: US 7,051,459 B1
(45) Date of Patent: May 30, 2006

(54) INSULATED LIGHTWEIGHT PACK BOOT

(76) Inventor: Jerald N. Wigutow, P. O. Box 2124, Grand Junction, CO (US) 81502

( * ) Notice: Subject to any disclaimer, the term of this patent is extended or adjusted under 35 U.S.C. 154(b) by 197 days.

(21) Appl. No.: 10/701,736

(22) Filed: Nov. 5, 2003

(51) Int. Cl.
*A43B 5/00* (2006.01)

(52) U.S. Cl. ..... 36/83; 36/10; 36/55

(58) Field of Classification Search ..... 36/10, 36/55, 117.1, 83, 93, 14
See application file for complete search history.

(56) References Cited

U.S. PATENT DOCUMENTS

| | | | | |
|---|---|---|---|---|
| 2,433,834 | A * | 1/1948 | Bazett et al. | 2/158 |
| 2,728,999 | A * | 1/1956 | Hollier | 36/4 |
| 3,461,026 | A | 8/1969 | Schick | 428/359 |
| 3,521,385 | A * | 7/1970 | Dalebout | 36/117.6 |
| 3,584,323 | A | 6/1971 | Worley | 5/413 |
| 3,842,454 | A | 10/1974 | Young | 2/69.5 |
| 3,952,134 | A | 4/1976 | Watson | 428/391 |
| 4,040,371 | A * | 8/1977 | Cooper et al. | 112/420 |
| 4,090,269 | A | 5/1978 | Hunt | 2/69.5 |
| 4,118,531 | A | 10/1978 | Hauser | 428/299 |
| 4,395,455 | A | 7/1983 | Frankosky | 428/298 |
| 4,588,635 | A | 5/1986 | Donovan | 428/299 |
| 4,845,862 | A * | 7/1989 | Phillips et al. | 36/83 |
| 4,910,055 | A | 3/1990 | Wigutow | 428/36.1 |
| 5,499,459 | A * | 3/1996 | Tomaro | 36/10 |
| 5,893,222 | A * | 4/1999 | Donnelly | 36/117.6 |
| 6,065,227 | A * | 5/2000 | Chen | 36/4 |
| 6,367,166 | B1 * | 4/2002 | Barthelemy et al. | 36/3 R |
| 6,464,907 | B1 | 10/2002 | Gross | 264/21 |
| 6,760,982 | B1 * | 7/2004 | Chen et al. | 36/55 |

FOREIGN PATENT DOCUMENTS

| | | |
|---|---|---|
| GB | 2155773 | 10/1985 |
| WO | 8103503 | 12/1981 |

OTHER PUBLICATIONS

Bass Pro Shops LaCrosse Extreme PFT Boots for Men; information from the internet—copyright 2003.
Bass Pro Shops Rocky Snowstalker Extremen Boots for Men; information from the internet-copyright 2003.
Bass Pro Shops LaCrosse 13" Buckmaster Boots for Men; information from the internet; copyright 2003.
An information sheet entitled "Perfect For Your Outdoor Rental Program", Wiggy's Bags; undated, admitted prior art.
An information sheet entitled "Wiggy's Bag", undated, admitted prior art.

* cited by examiner

*Primary Examiner*—Jila M. Mohandesi
(74) *Attorney, Agent, or Firm*—MacCord Mason PLLC

(57) ABSTRACT

A lightweight cold and wet weather pack boot comprising an outer boot including an upper boot with an exterior material layer constructed of waterproofing coated polyester, an interior layer of oxford nylon with insulation batting between the exterior and interior layers, further including a molded rubber bottom with cleats, and an inner bootie with outer and inner layers of oxford nylon with insulations between said outer and inner layers.

8 Claims, 4 Drawing Sheets

INSULATED LIGHTWEIGHT PACK BOOT

BACKGROUND OF THE INVENTION

This invention relates to pack boots with improved insulation.

Pack boots are well known in the prior art. Pack boots comprise an outer boot and an inner bootie, providing insulation and protection from cold and damp weather. The outer boot very often has a leather or canvas upper with a molded, rubber boot bottom. The boot bottoms have cleats molded into the boot sole to provide traction in rough and wet terrain. Leather or canvas upper boots tend to absorb moisture and pass this moisture to the inner bootie. The inner booties are very often made of felt or other synthetic materials. An individual's feet will sweat profusely with exercise, such as walking, hiking, and the inner bootie may absorb the moisture from the sweat. Once these liners absorb moisture, the wearer's feet can get very cold as the outside cold temperatures pass through the upper boots leather or canvas exterior layers. Very often, the inner booties can slip within the outer boot while the user is walking, thereby making use of these pack boots somewhat uncomfortable. The traditional pack boots have been very heavy, having an average weight per boot in the 4 to 6.5 pound per boot range. Consequently, the wearer experiences fatigue much sooner than he or she would with lighter boots.

Accordingly, there is a need to have lightweight, waterproof pack boots with effective insulation to keep the heat within the inner bootie and to prevent the outside cold and moisture from passing though the outer boot into the inner bootie. The boots preferably are waterproof, and the inner bootie does not slip or slide within the outer boot.

SUMMARY OF THE INVENTION

The present invention fulfills one or more of these needs by providing a lightweight, well-insulated pack boot for use in cold and/or wet weather. An exemplary insulated pack boot comprises an outer boot with a rubber bottom, an inner bootie placed within said outer boot, and insulation of said outer boot and inner boot with batting. The insulation batting comprises an inner layer of unquilted and unbonded continuous filament fibers which may be provided with a silicone finish, and a inner layer comprising a scrim of chopped staple fibers. The outer boot includes an upper boot which is constructed of an exterior and interior layer. The exterior layer is preferably 1000 denier coated polyester, which has been waterproofed. The interior layer is preferably constructed of 200 denier oxford nylon. The upper boot includes 6 ounces (per boot) of insulation batting placed between the exterior and interior material layers. The insulation batting is laminated to the interior layer.

The preferred apparatus further includes an inner bootie which has an exterior and an interior layer made of 200 denier oxford nylon. Twelve ounces per boot of Lamilite® insulation is placed between the inner and outer layer of the inner bootie and is laminated to the inner layer. The bootie further includes a rubberized sole which provides traction and to eliminate slippage within the outer boot. The inner bootie also includes a hook and loop strap and patch at the top of the bootie to permit tightening and loosening adjustments of the bootie for a snug fit.

Lamilite® insulation comprises an inner layer of insulation material formed from unquilted, unbonded continuous filament fibers preferably provided with a silicone finish, and a layer of chopped staple fibers. The inner layer insulating material is preferably 6 denier continuous filament polyester yarn. The insulation is formed into batting of various weights. The average weight of the insulated pack boot according to the preferred embodiments is 2 pounds, 8 ounces, per boot.

The insulation may also comprise an inner layer of insulation material formed from unquilted and unbonded continuous filament fibers provided with a silicone finish enclosed between two layers of chopped staple fibers.

BRIEF DESCRIPTION OF THE FIGURES

The invention will be better understood by a reading of the Detailed Description of the Preferred Embodiments along with a review of the drawings, in which.

DETAILED DESCRIPTION OF THE PREFERRED EMBODIMENT

Figure 1:
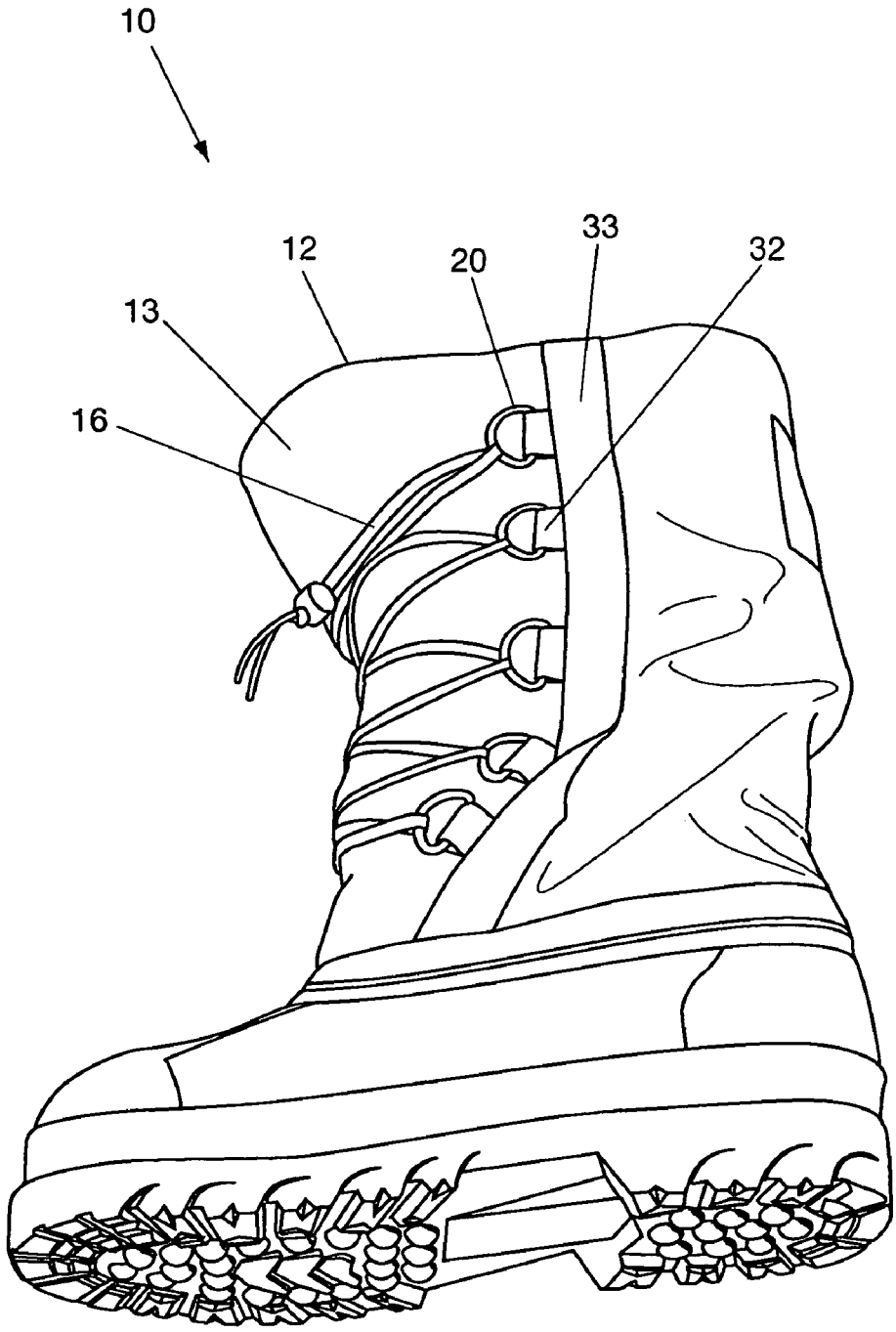
FIG. 1 is a side view of the preferred embodiment of the invention.

In the following description, like reference characters designate like or corresponding parts throughout the several figures. It should be understood that the illustrations are for the purpose of describing preferred embodiments of the invention and are not intended to limit the invention thereto.

Figure 2:
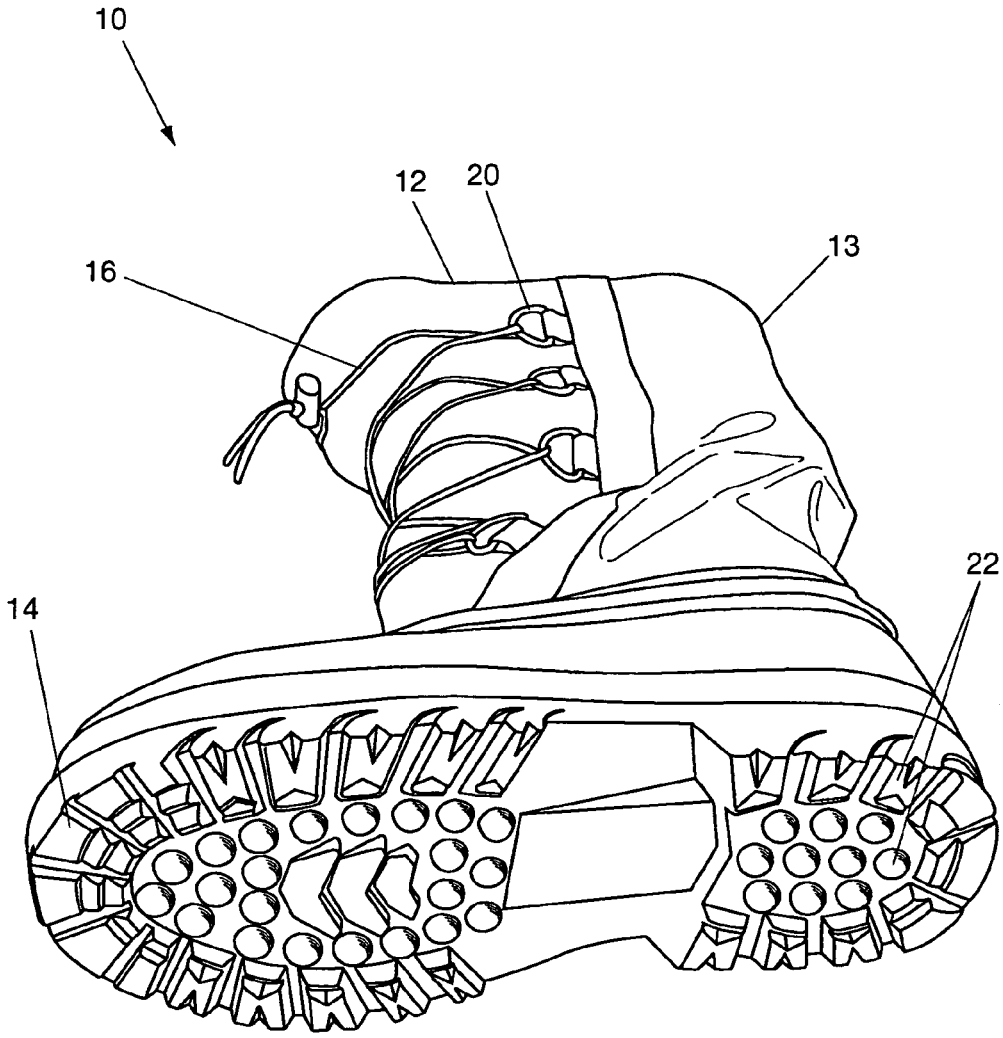
FIG. 2 is a bottom view of the preferred embodiment of the invention.
Figure 3:
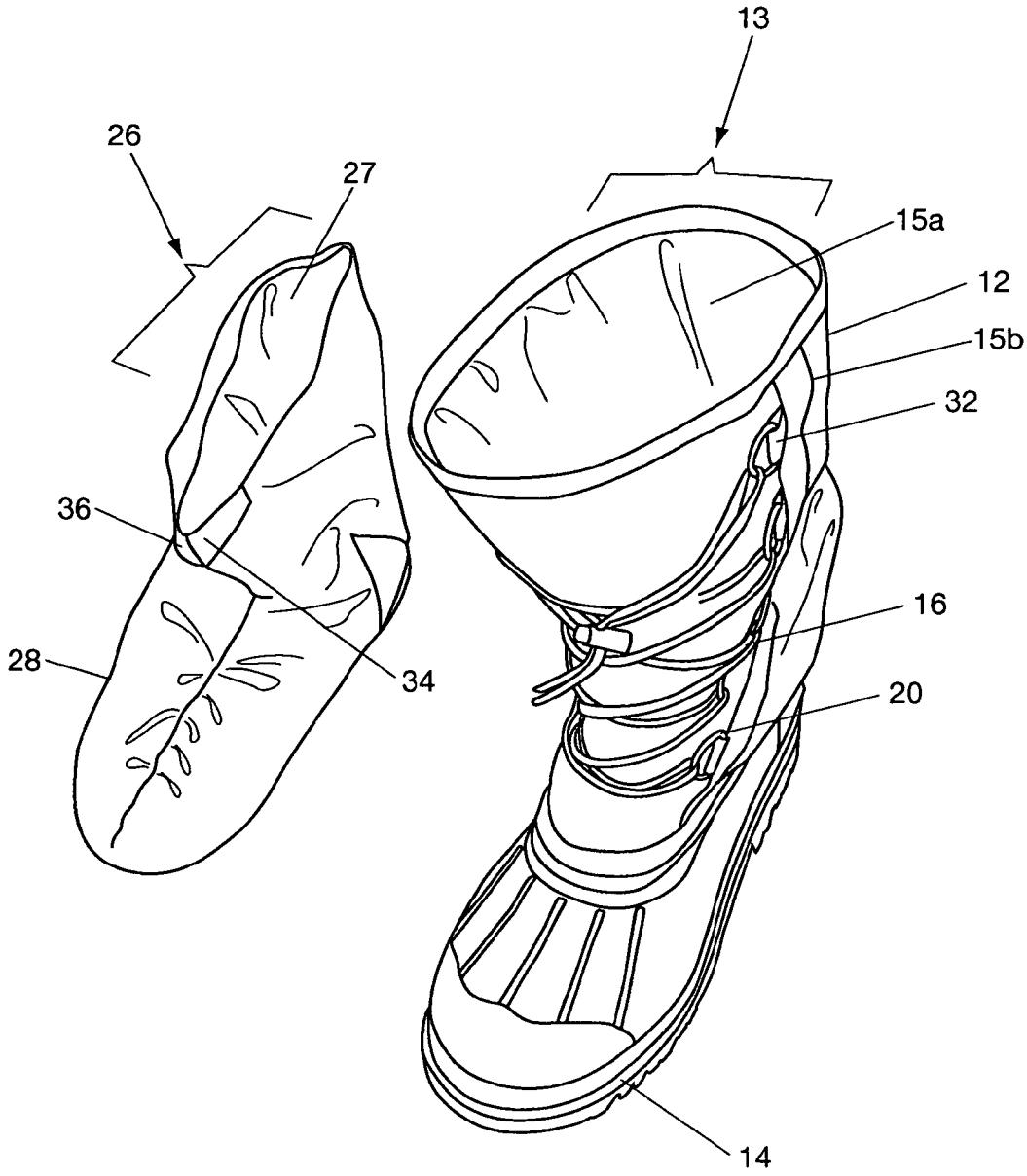
FIG. 3 is a top view of the outer boot and inner bootie.

As best seen in FIGS. 1 through 3, an apparatus according to the preferred embodiment of the invention includes a lightweight, cold and wet weather insulated pack boot 10 which includes an outer boot 13 and an inner bootie 26. The inner bootie 26 is placed within the outer boot 13 during use but can also be worn separately.

The outer boot 13 includes an upper boot 12 which is constructed of an interior 15A and exterior 15B material layer. The exterior layer 15B is constructed of woven 1000 denier coated polyester. This exterior layer 15B is coated with a waterproofing agent. The inner layer 15A of the upper boot 12 is constructed of 200 denier oxford nylon. The upper boot 12 further includes insulation, which is placed between the exterior 15*b* and inner 15*a* material layers and is laminated to the interior layer. In the preferred embodiment, the insulation utilized is about 6 ounces of Lamilite® per boot. The upper boot 12 further includes lace eyelets 20. Two eyelet straps 33 with eyelet tabs 34 containing the eyelets 20 are sewn to the exterior layer 15*b* of the upper boot 12. The eyelet straps 33 extend from the top of the upper boot 12 to the bottom of the upper boot 12 at a slight angle. The distance between the eyelet straps 33 provides sufficient space for the wearer to properly secure the pack boot 10 by tightening and tying laces 16 threaded through the eyelets 20. The outer boot 13 further includes a lower boot 14. The lower boot 14 is constructed of molded rubber and includes cleats 22 on the sole of the lower boot 14. The cleats 22 are utilized for traction on uneven or wet terrain.

Figure 4:
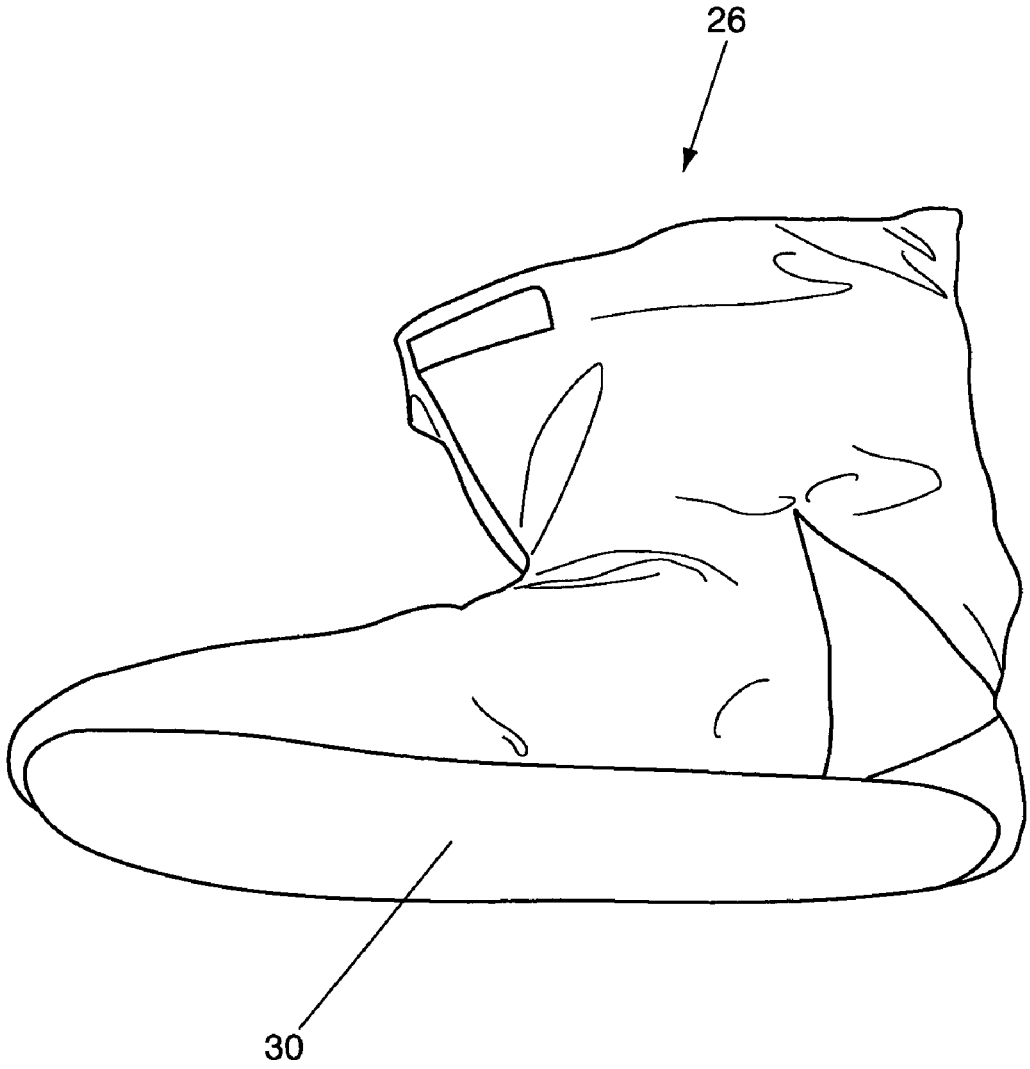
FIG. 4 is a side view of the inner bootie.

Referring now to FIGS. 3 and 4, the pack boot 10 includes the inner bootie 26. The inner bootie 26 has an exterior 28 and interior 27 layer constructed of 70 denier nylon taffeta. The inner bootie 26 further includes insulation between the two layers. The insulation utilized is about 12 ounces of Lamilite® in the preferred embodiment and is laminated to the inside of the inner material layer 27 forming the inner bootie 26. The inner bootie 26 includes a rubberized sole 30 sewn into the inner bootie 26, which provides traction when the bootie is worn without the outer boot 13 and eliminates slippage of the inner bootie 26 within the outer boot 13. The inner bootie 26 also includes a hook and loop strap 36 and a hook and loop patch 34 which is utilized to tighten and loosen the top of the inner bootie 26 to provide the wearer with a snug, comfortable fit.

The Lamilite® insulation in the preferred embodiment includes a layer of insulation material formed from unquilted and unbonded continuous filament fibers with a silicone finish and a scrim layer of chopped staple fibers. The composition of the Lamilite® insulation is an improvement of the Lamilite® insulation as described in U.S. Pat. No. 4,910,055 issued to Wigutow on Mar. 20, 1990, which forms batting. The disclosure of that patent is hereby incorporated by reference. In an alternate embodiment the insulation set forth in the U.S. Pat. No. 4,910,055 may be used in the pack boots. The insulation material is formed from a layer of unquilted and unbonded continuous filament fibers with a silicone finish enclosed between two outer layers of chopped staple fibers.

In the preferred embodiment 6 denier continuous filament polyester yarn is used to manufacture the insulation material of the interior layer of the insulation batting. The appropriate weight insulation batting is laminated to the inner layer 15*a* of the material in the outer boot 12 and the inner layer 27 of the inner bootie 26. The only stitching of the insulation stock to the interior and exterior material layers of the outer boot 12 and the inner bootie 26 is perimeter stitching. Consequently, the filaments of the inner layer of unbonded continuous filament fibers in the insulation batting are free to move with respect to one another, resulting in much greater loft than insulation batting that is quilted. The more loft in the insulation, the more warmth for the wearer. The loft of this insulation stock retains the heat generated by the foot within the inner bootie 26 and outer boot 12, while keeping the outside cold and moisture from penetrating within the pack boot 10. One washing of the inner bootie 26 provides an approximate 10% increase in the amount of loft. Successive additional washes give the insulation increasingly more loft. The outer boot 12 includes an oversized lower boot 14 to accommodate the loft expansion of the insulators within the inner bootie 26.

The pack boot 10 has an average weight of 2 pounds, 8 ounces per boot. Average weight of a pack boot is determined by the weight of a single size 9½ boot. Other pack boots currently on the market are significantly heavier than the pack boot of this invention. For example, the LaCrosse Extreme PFT pack boot has an average weight per boot of 6.5 pounds. The La Crosse 13– Buckmaster pack boot has an average weight of 4.0 pounds per boot, and the Rocky Snowstalker pack boot has an average weight of 4.5 pounds per boot. The lighter the boot, the less fatigue the user will experience while walking or hiking for extended distances. The pack boot 10 of the preferred embodiment can be worn with only one pair of woolen socks and will keep the wearer warm and comfortable in temperatures as low as −40 degrees Fahrenheit.

Certain modifications and improvements will occur to those skilled in the art upon reading the foregoing description. It should be understood that all such modifications and improvements have been omitted for the sake of conciseness and readability, but are properly within the scope of the following claims. For example, other fabric deniers can be used. Other compoundable insulation structures can be substituted.

What is claimed is:

1. A lightweight, cold and wet weather insulated Pack boot comprising:

an outer boot including an upper boot with an exterior material layer constructed of 1000 denier waterproofing coated polyester, an interior layer of 200 denier oxford nylon, 6 ounces of insulation batting between said exterior and interior material said insulation batting formed from a layer of said insulation unquilted and unbonded continuous filament fibers provided with a silicone finish and a layer of chopped staple fibers; and an inner bootie with outer and inner layers constructed from 70 denier nylon taffeta, 12 ounces of insulation batting between said outer and inner layers, a rubberized sole, a hook and loop strap and patch permitting-fit adjustments for a snug fit.

2. The apparatus according to claim 1, wherein said filament filters are about 6 denier continuous filament polyester yarn.

3. The apparatus according to claim 1, wherein said outer boot comprises an upper boot and a lower boot.

4. The apparatus according to claim 1, wherein the insulation batting in the outer boot is laminated to said interior material layer.

5. The apparatus according to claim 1, wherein said hook and loop strap and patch are positioned to permit tightening and loosening adjustments of said inner bootie for a snug fit.

6. The apparatus according to claim 1, wherein the weight of a size 9½ insulated pack boot is less than 4 pounds.

7. The apparatus according to claim 1, wherein the average weight of a size 9½ insulated pack boot is about 2.8 pounds.

8. The apparatus according to claim 1, wherein said unquilted and unbonded continuous filament fibers are enclosed between layers of chopped staple fibers.

* * * * *